United States Patent [19]

Kibbie

[11] 4,425,982

[45] Jan. 17, 1984

[54] DEVICE AND METHOD FOR ESCAPING FIRE AND SMOKE IN HIGH-RISE BUILDINGS

[76] Inventor: William E. Kibbie, 1210 Mabury Ave., Santa Ana, Calif. 92701

[21] Appl. No.: 242,322

[22] Filed: Mar. 10, 1981

[51] Int. Cl.[3] ..... A62B 1/02

[52] U.S. Cl. ..... 182/36; 182/3; 182/82

[58] Field of Search ..... 182/3, 5, 6, 7, 36, 182/37, 10, 82, 142, 45

[56] References Cited

U.S. PATENT DOCUMENTS

| | | | |
|---|---|---|---|
| 414,476 | 11/1889 | Allgrove | 182/142 |
| 1,297,800 | 3/1919 | Cranford | 182/36 |
| 2,478,004 | 8/1949 | Newell | 182/3 |
| 3,679,026 | 7/1972 | Hansen | 182/82 |
| 3,760,901 | 9/1973 | Hynes | 182/7 |
| 4,004,778 | 1/1977 | Steinhagen | 182/184 |
| 4,096,922 | 6/1978 | Fisher | 182/142 |

FOREIGN PATENT DOCUMENTS

| | | | |
|---|---|---|---|
| 1914952 | 10/1970 | Fed. Rep. of Germany | 182/3 |
| 5882 | of 1911 | United Kingdom | 182/3 |
| 391249 | 12/1973 | U.S.S.R. | 182/36 |

*Primary Examiner*—R. P. Machado

*Attorney, Agent, or Firm*—Knobbe, Martens, et al.

[57] ABSTRACT

In the event of fire, a telescoping pole is transported, by means of a hoist, from a stored location within a building to a sleeve permanently mounted on a balcony or near a window. The pole is inserted into the sleeve and telescoped to its full extended position. A trolley is mounted on this pole. The user straps himself in a seat, attaches the seat to the trolley, and suspends himself from the pole. Using a hand-over-hand motion, the user propels himself away from the building to the end of the pole where he may be rescued by firemen.

In a second embodiment, the pole is telescopingly mounted and permanently stored in the sleeve, thereby eliminating the need to transport the pole. The sleeve is pivotally mounted on a stand for rotation about a vertical axis and the pole, when stored therein, is interior to the side of the building. In the event of fire, the user manipulates the pole by rotating it to a position which permits it to be telescopingly extended away from the side of the building. After extending the pole, the user escapes from the fire by means of the trolley and seat, as described above.

1 Claim, 13 Drawing Figures

DEVICE AND METHOD FOR ESCAPING FIRE AND SMOKE IN HIGH-RISE BUILDINGS

BACKGROUND OF THE INVENTION

The present invention relates to life saving devices and method for use in high-rise buildings to escape the heat and smoke of a fire.

Each year, a substantial number of fires occur in high-rise buildings, even those meeting state and local fire codes. As a result, many persons have been killed or seriously injured due to burns, smoke inhalation, or from falls caused by jumping out of windows or off balconies to escape the fire. Typically, it is difficult to upgrade the fire safety of existing high-rise buildings because such upgrading often requires extensive structural modifications. Of course, such structural modifications may be avoided by installing fire escape devices, such as ladders and poles, on the exterior of the buildings. One such fire escape device is illustrated in U.S. Pat. No. 3,760,901, issued to Hynes. Building owners, however, have been reluctant to mount fire escape devices on the outside of their buildings, apparently because they protrude therefrom, and thus, are aesthetically displeasing. Moreover, such devices may tend to deteriorate rapidly due to exposure to the outside environment, and therefore, they may not function properly in an emergency. Furthermore, the prior art devices are typically not readily accessible, and thus, are difficult to use, particularly for disabled persons.

SUMMARY OF THE INVENTION

The present invention alleviates these and other problems of the prior art by providing a simple, easily installed, dependable, readily accessible and aesthetically unobjectionable floor-mounted fire escape device which may be retrofitted to existing high-rise buildings without structural modifications.

This device comprises a portable, telescoping pole which is inserted into a sleeve of a stand permanently mounted near a window or on a balcony. After insertion, the user telescopes the pole outwardly, away from the building, to its maximum extension. Such extension may, for example, place the end of the pole about 15 feet from the side of the building.

A trolley mechanism, comprising an hourglass-shaped roller connected between the forks of a yoke, is mounted to roll along the sleeve. The roller is positioned to engage the top of the sleeve to permit the trolley to travel along the sleeve and onto the pole. The user straps himself into a seat, attaches the seat to the trolley mechanism, and eases himself over the window ledge or balcony rail so that he is suspended from the pole by the trolley mechanism. He then pushes himself away from the building and travels to the end of the pole where he may be rescued by firemen. If help is not available, he may wait until the fire is under control and then return to his room by way of the window or balcony.

In a first embodiment, the telescoping pole is portable and may be stored indoors, for example, under a bed or in a closet. Thus, the pole is protected against the deterioration associated with fire escapes that are permanently mounted out-of-doors. This insures that the pole will function properly in the event of an emergency. Further, since the pole may be stored out of sight until needed, the fire escape device of the present invention is aesthetically unobjectionable.

The pole may be manufactured of any strong, relatively rigid, material, such as steel. However, if the pole is made of metal, its weight may make it difficult to lift. Accordingly, the present invention includes a portable hoist which may be used to transport the pole and position it for insertion into the sleeve. This allows virtually any person, including the weak and elderly, to use the present invention without difficulty. The hoist is approximately the size of a small serving cart, and therefore, it may be stored out of sight in a closet or other suitable location.

A second embodiment of the present invention is similar to the first embodiment, except that the pole, instead of being portable, is permanently stored in the sleeve, preferably indoors. The sleeve is pivotally mounted on a stand for rotation about a vertical axis. When in its stored position, the pole is interior to the side of the building to prevent it from protruding therefrom. Further, the sleeve may be adapted to advantageously provide support for a table top or bar top. Such table or bar top, in addition to being functionally advantageous, also provides an aesthetically pleasing cover for the pole and sleeve. Moreover, if the sleeve is mounted out-of-doors, the top provides protection against the elements. In the event of fire, the user removes the top, and pivots the pole to a position which is perpendicular to the side of the building. The user then telescopes the pole away from the building to its full, extended position, mounts the seat, and travels along the pole to escape the fire in the manner described above. Thus, this alternative embodiment eliminates the need for a hoist, and the concommitant need to transport and mount the pole.

In either embodiment, the stand is floor-mounted and sized to support the pole at a distance of preferably 3–5 feet from the floor to insure that the pole is readily accessible to virtually all persons, including the disabled.

BRIEF DESCRIPTION OF THE DRAWINGS

These and other advantages of the present invention are best understood through reference to the drawings in which.

DETAILED DESCRIPTION OF THE PREFERRED EMBODIMENT

Figure 1:
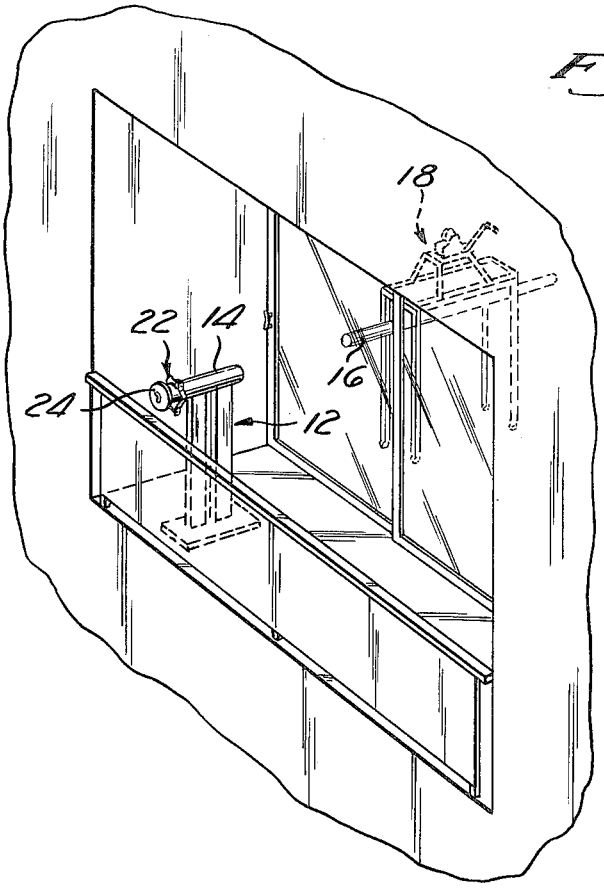
FIG. 1 is a perspective view of the stand of the present invention permanently mounted on a balcony showing the telescoping pole being transported by the hoist from its stored location to the stand.
Figure 2:
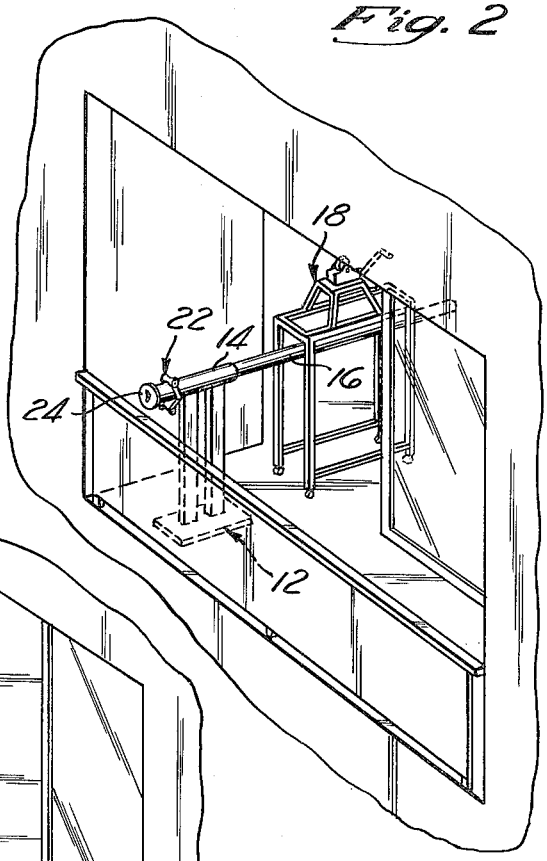
FIG. 2 is a perspective view of the telescoping pole of the present invention being supported by the hoist, and positioned for insertion into the sleeve of the stand.
Figure 3:
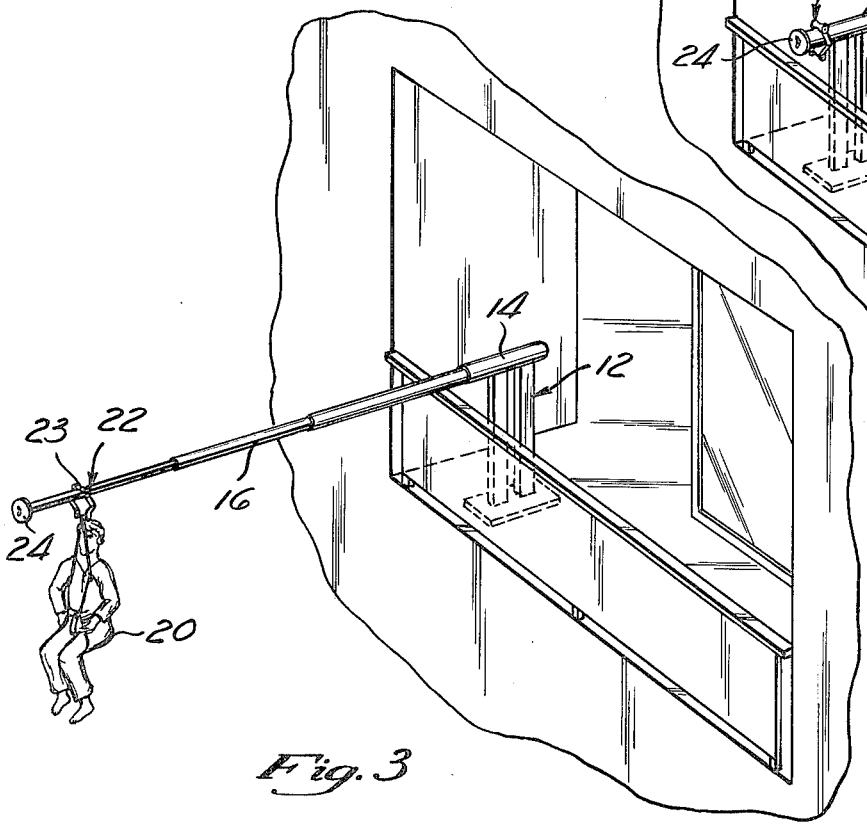
FIG. 3 is a perspective view of the pole after it has been inserted into the sleeve and telescopingly extended outwardly, showing the user being supported by the seat, suspended from the pole by the trolley mechanism.
Figure 4:
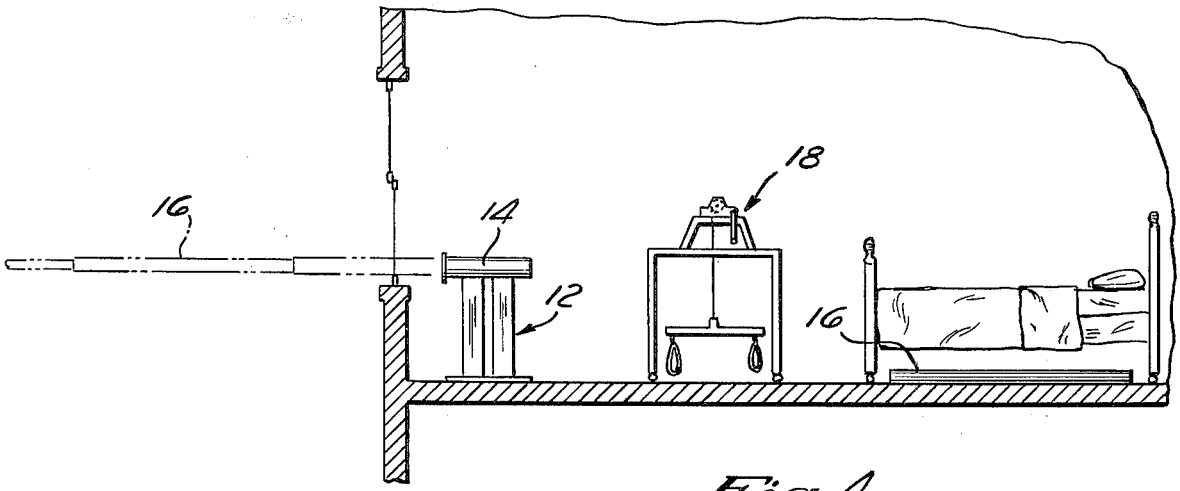
FIG. 4 is an elevation view of the stand, mounted inside a room, and oriented to permit the telescoping pole to extend outward through the window, as shown in phantom lines; the pole may be stored underneath a bed when not in use, as shown in solid lines.

The present invention includes a stand 12 permanently mounted on the floor of a high-rise building, near an opening in the periphery of the building, for example, on a balcony, as shown in FIGS. 1, 2, and 3. Alternatively, the stand 12 may be mounted inside the building, adjacent to a window, as shown in FIG. 4. The stand 12 has a tubular sleeve 14 which receives tubular telescoping pole 16. The pole 16 may be stored in a closet or under a bed (FIG. 4). A portable hoist 18 is provided to lift the telescoping pole 16, transport it from its stored location to the stand 12, and position it for insertion into the sleeve 14, as shown in FIGS. 1 and 2. The sleeve 14 is oriented so that, after the pole 16 is inserted therein, the user may telescope the pole outwardly, away from the building, to its maximum extension, as shown in solid lines in FIG. 3 and in phantom lines in FIG. 4.

To escape a fire, the user fully extends the pole, as discussed above, straps himself into a seat 20, and attaches the seat 20 to a trolley mechanism 22 mounted on the sleeve 14. He then eases himself over the balcony rail (FIG. 3) or window ledge (FIG. 4) so that he is suspended from the trolley mechanism 22, as shown in FIG. 3. This trolley 22 has a roller 23 which engages the top side of the pole 16. Preferably, the seat 20 should be suspended beneath the pole 16 at a distance which permits the user to grasp the pole 16 and, using a hand-over-hand motion, propel himself away from the building. A stop plate 24, substantially larger than the outward end of the extended pole 16, is provided to stop the user's travel when he reaches the end of the pole 16.

Figure 5:
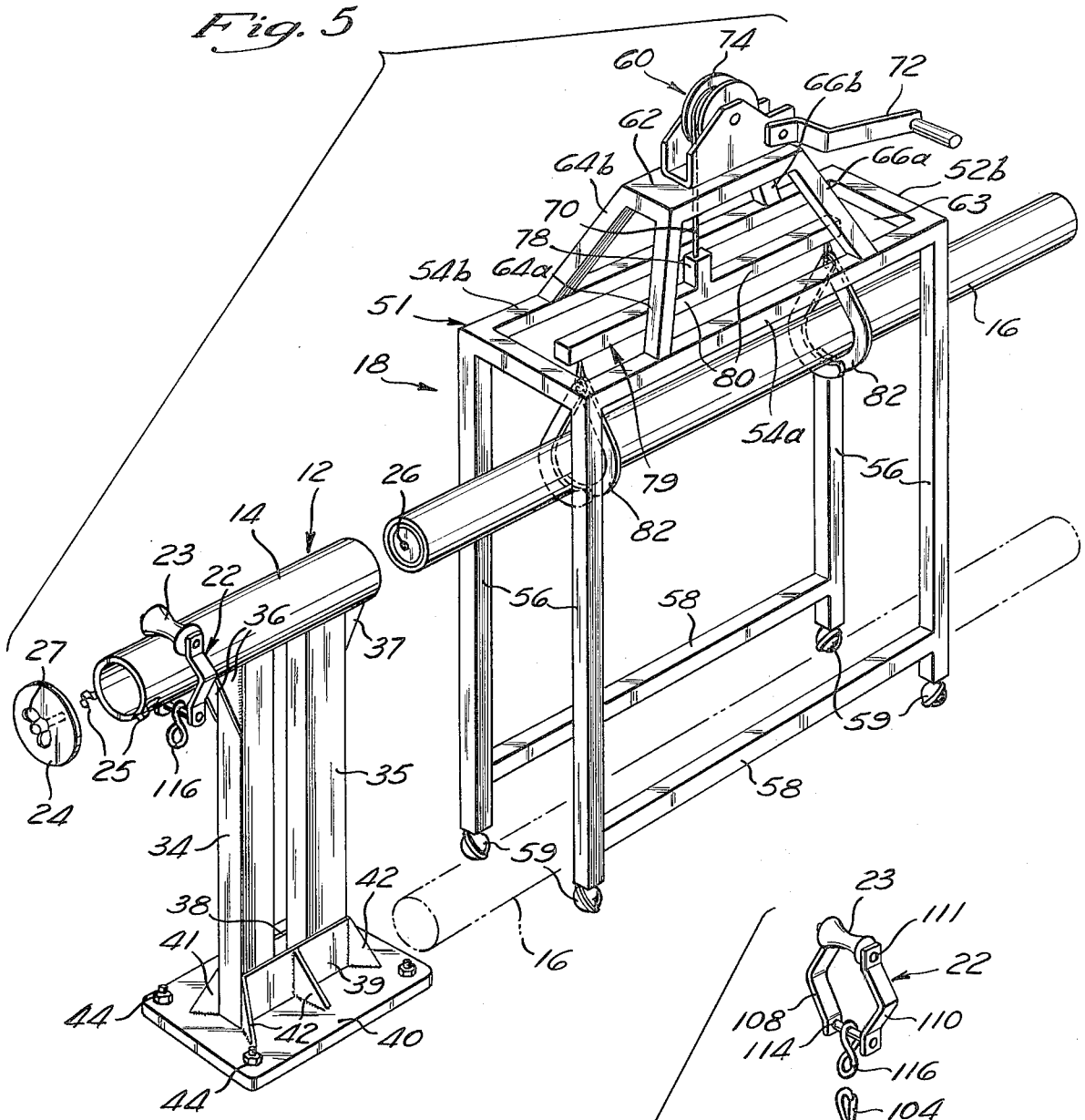
FIG. 5 is a perspective view showing the stand with the trolley mechanism and stop plate stored thereon, and showing the hoist supporting the telescoping pole, with the pole aligned for insertion into the sleeve of the stand.

Referring to FIG. 5, the stop plate 24 is stored on the outward end of the sleeve 14 and is retained thereon by spring clips 25. This advantageously shelters the interior of the sleeve 14 from rain or other adverse environments that may cause corrosion. If desired, the other end of the sleeve may be closed with a cap (not shown). The telescoping end of the pole 16 has a threaded bore 26 in the center thereof. When the pole 16 is inserted into the sleeve 14, this bore 26 aligns with a wing bolt 27 in the center of the stop plate 24. Tightening the wing bolt 27 firmly attaches the stop plate 24 to the pole 16. Once the stop plate 24 has been attached, the spring clips 25 are released and the pole 16 is extended outwardly, away from the building, as discussed above.

Figure 6:
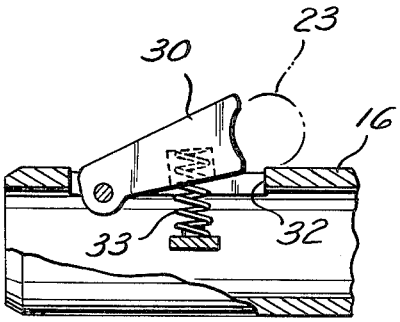
FIG. 6 is an elevation view in partial cross-section of a retractable stop which may be used instead of the stop plate to prevent the trolley mechanism from rolling off the end of the pole.

As an alternative to the stop plate 24, the end of the pole 16 may include a spring loaded retractable stop 30, shown in FIG. 6. The retractable stop 30 is pivotally mounted at one end in a cutout 32 of the pole 16. The cutout 32 is sized to permit the stop 30 to fully retract therein, so that its outer surface is flush with the outer surface of the pole 16. A spring 33 is provided to bias the stop 30 radially outward to the position shown in FIG. 6. When the pole 16 is inserted into the sleeve 14, the stop 30 is depressed into the cutout 32 so that the pole 16 slides through the sleeve 14 without being inhibited by the stop 30. Similarly, the stop 30 may be depressed to permit the trolley mechanism 22 (FIG. 3) to be slid over the end of the pole 16 and past the retractable stop 30. When the stop 30 is released, the biasing spring 33 moves it radially outward, as shown in FIG. 6. The pole 16 is rotated, if necessary, to position the stop 30 on top of the pole 16, so that the roller 23 (shown in phantom) of the trolley mechanism 22 (FIG. 3) is prevented from rolling past the retractable stop 30 and off of the end of the pole 16. Thus, the retractable stop 30, like the stop plate 24, functions to limit outward travel of the trolley 22 (FIG. 3) along the pole 16.

Referring again to FIG. 5, the sleeve 14 of the stand 12 is connected to and supported by a pair of upright beams 34,35. The beams 34,35 are sized to position the sleeve 14 above the balcony railing in a horizontal position, with its longitudinal axis oriented perpendicularly to the side of the building. Two pairs of wedge-shaped members 36,37 are connected between the beams 34,35, respectively, and the sleeve 14 to provide additional support for the sleeve 14. The support members 36,37, beams 34,35, and sleeve 14 are fastened together, such as by welding. The beams 34,35 are retained in a channel formed by a pair of upright plates 38,39, connected to a base plate 40. Two sets of three wedge-shaped support members 41,42 provide additional support to rigidly retain the plates 38,39, respectively, in position on the base plate 40. The beams 34,35, plates 38,39, support members 41,42, and base plate 40 are also fastened together, such as by welding. Bolts 44 are provided to attach the base plate 40 to the floor of the balcony.

It will be understood that, rather than supporting the sleeve 14 on the beams 34,35, the sleeve 14 may be built into a windowsill or balcony rail of the building.

As mentioned above, the hoist 18 may be used to transport the pole 16 and position it for insertion into the sleeve 14. The hoist 18 includes a horizontal, rectangular frame 51 comprised of a pair of parallel bars 52(*a*), 52(*b*) connecting and oriented perpendicularly to a second pair of parallel bars 54(*a*), 54(*b*), longer than the bars 52. Projecting downward from each of the four corners of the frame 51 are legs 56. A pair of cross bars 58 are connected between the respective lower portions of the legs 56, in parallel relationship to the bars 54, to provide additional strength. However, no corresponding cross bars are provided in parallel relationship to the bars 52 since, as will be discussed below, this would prevent the hoist 18 from lifting the pole through the entire vertical length of the legs 56. Casters 59 are attached to the bottom of each of the legs 56 to permit the hoist 18 to roll along the floor. A winch 60 is mounted on a platform 62 above the rectangular opening 63 formed by the frame 51. The corners of the rectangular platform 62 are connected to the bars 54(*a*), 54(*b*) by legs 64(*a*), 66(*a*), and 64(*b*), 66(*b*), respectively. The winch cable 70 is raised and lowered by rotating a crank handle 72 which drives the winch take-up reel 74 through a gear train (not shown). This cable 70 is connected to the vertical base portion 78 of an inverted T-bar 79. The T-bar 79 includes a horizontal cross member 80, perpendicularly connected to the base portion 79. The T-bar cross member 80 is oriented in parallel relationship to the bars 54 and is sized to fit within the opening 63 formed by the frame 51. Suspended from each end of the T-bar cross member 80 are respective clamps 82. These clamps 82 each comprise a pair of hooks, pivotally mounted at a common pivot point, and oriented to grasp the pole 16 from opposite directions. Thus, by positioning the hoist 18 over the pole 16 so that the pole 16 is parallel to the members 54 of the frame 51, clamping the clamps 82 to the pole 16, and rotating the winch crank handle 72, the pole 16 may be raised off the floor, from the position shown in phantom lines to the position shown in solid lines in FIG. 5. The height of the pole 16 and position of the hoist 18 are then adjusted, relative to the position of the sleeve 14, to align the pole 16 for insertion into the sleeve 14.

Figure 7:
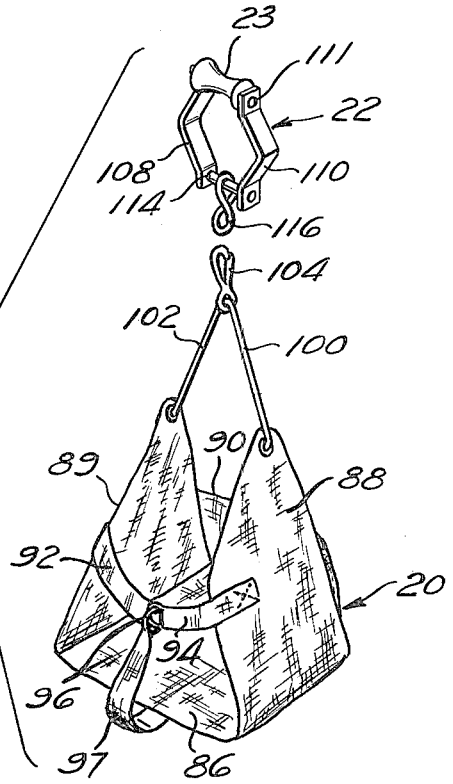
FIG. 7 is a perspective view showing the seat into which the user straps himself and the trolley mechanism from which the user is suspended on the pole.

After the telescoping pole 16 has been inserted into the sleeve 14 and fully extended, as shown in FIG. 3, it will be recalled that the user straps himself into a seat 20, attaches the seat 20 to the trolley mechanism 22, and travels along the pole 16 to the stop plate 24. Referring to FIG. 7, the seat 20 comprises a bottom portion 86, a pair of side portions 88,89, and back portion 90. A pair of straps 92,94, connected to the side portions 88,89, respectively, are joined together by a clasp 96 to form a seat belt across the abdomen of the user. A third strap 97, connected to the bottom portion 86, passes between the user's legs and is joined to the straps 92,94 by the clasp 96. A pair of cords 100,102 connect the side portions 88,89 to a clasp 104. The clasp 104 may be used to detachably connect the seat 20 to the trolley mechanism 22.

The trolley mechanism 22 comprises a pair of V-shaped members connected together at one end by the axle 111 of the roller 23 and at the other end by a pin 114. The members 108,110 are oriented and sized to permit the trolley mechanism 22 to loosely fit around the outward end of the sleeve 14, with the roller 23 contacting the top surface of the sleeve 14, as shown in FIG. 5. The diameter of the stop plate 24 is large enough to retain the trolley 22 on the sleeve 14, and thus, the trolley 22 may be stored in this position. The roller 23 is hourglass shaped to more or less conform to the tubular contours of the sleeve 14 and pole 16. The pin 114 is inserted through one of the eyelets of a figure-8 shaped link 116 while the other eyelet of the link 116 receives the clasp 104 of the seat 20. Thus, the link 116 permits the seat 20 to be suspended from the trolley mechanism 22.

Figure 8:
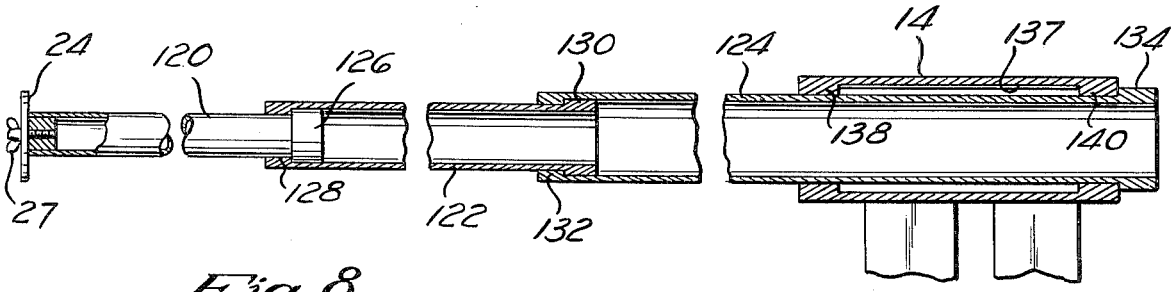
FIG. 8 is an elevation view in partial cross-section of the telescoping pole mounted in the sleeve, showing the bearing portions of the tubes comprising the pole.

Referring to FIG. 8, the telescoping pole 16 may be comprised of three concentric tubes 120,122,124 of progressively decreasing diameters. Each of these tubes 120,122,124 will be referred to hereinafter as having a "proximal end" and a "distal end". The proximal ends of the tubes 120,122,124, respectively, are those ends that are closest to the sleeve 14 when the extended pole 16 is mounted therein, while the distal ends are those farthest from the sleeve 14. Thus, after the pole 16 has been mounted in the sleeve 14 and fully extended, the proximal end of the tube 120 will be supported by the distal end of the tube 122, the proximal end of the tube 122 will be supported by the distal end of the tube 124, and the proximal end of the tube 124 will be supported by the sleeve 14.

The proximal end of the tube 120 has an enlarged diameter bearing portion 126 which is sized to telescopingly slide within the tube 122. Further, the distal end of the tube 124 has a reduced diameter bearing portion 128, sized to permit the tube 120 to telescopingly slide therein. Thus, the bearing portions 126,128 cooperate to permit the tube 120 to telescopingly slide in the tube 124. Since the bearing portion 128 has a smaller diameter than the bearing portion 126, the portions 126,128 cooperate to provide a stop for preventing the tube 120 from sliding completely out of the tube 124. Likewise, the proximal end of the tube 122 and distal end of the tube 124 have a corresponding enlarged diameter bearing portion 130 and corresponding reduced diameter bearing portion 132, respectively, which function in the same manner as the bearing portions 126,128 to permit the tube 122 to telescopingly slide in the tube 124, while preventing the tube 122 from sliding completely out of the tube 124. The proximal end of the tube 124 has an enlarged diameter portion 134 which abutts the end of the sleeve 14 to prevent the tube 124 from passing outwardly therethrough. In addition, the center portion 137 of the sleeve 14 has a slightly larger inside diameter than the end portions 138,140. Thus, the tube 124 telescopingly slides in the end portions 138,140 without contacting the center portion 137. This reduces friction between the tube 124 and sleeve 14 and thereby permits the pole 16 to be inserted more easily. It also advantageously reduces the amount of material required to form the sleeve 14.

It will be understood that the number, as well as the length and configuration of the telescoping concentric tubes 120,122,124 may be varied depending, for example, on the desired overall length, strength, and weight of the pole 16. However, in any case, the pole, when fully extended, should be of sufficient length and strength to permit the user to place himself at a distance from the side of the building that provides him reasonable protection against a fire. In an exemplary form of the present invention, which has been constructed from A.I.S.I. 1018 seamless steel tubing, it has been found that three six-foot tubes having the following dimensions provide a 17-foot telescoping pole capable of supporting a 250-pound person with a safety margin of 4 to 1:

| | Outside Diameter (inches) | Inside Diameter (inches) |
|---|---|---|
| Tube 120 | 3.250 | 2.875 |
| Tube 122 | 4.0 | 3.5 |
| Tube 124 | 5.0 | 4.375 |

A pole manufactured to the above specifications with suitable bearing portion 126, 128, 130, 132 dimensions, and inserted into a 12-inch by 5.2-inch (O.D.) tubular sleeve, mounted with its outward end next to the edge of a balcony or window, permits the user to travel approximately 15–16 feet away from the side of a burning building.

It will be recognized that the above-described embodiment may include additional safety equipment, such as gas masks for protection against smoke, asbestos blanket "cocoons" for protection against heat, signal lights, air horns, and hard hats, any or all of which may be attached to the seat 20. Further, a sling (not shown) may be used in place of the seat 20 to accommodate handicapped persons. The sling or seat 20 may include a quick release hook for helicopter rescue. So long as the pole 16 is sufficiently strong, more than one seat 20 per pole 16 may be provided to permit additional users to use a single pole 16. If desired, additional poles 16 may be provided in strategic locations so that persons are not confined to one escape route, and thus, may choose an escape route away from the fire.

In a second embodiment of the present invention, shown in FIGS. 9 through 13, the pole 16 is permanently stored in the sleeve 14, thereby eliminating the need for the hoist 18 and the concommitant need to transport the pole 16. This substantially reduces the time required in using the present invention to escape from a fire.

Figure 9:
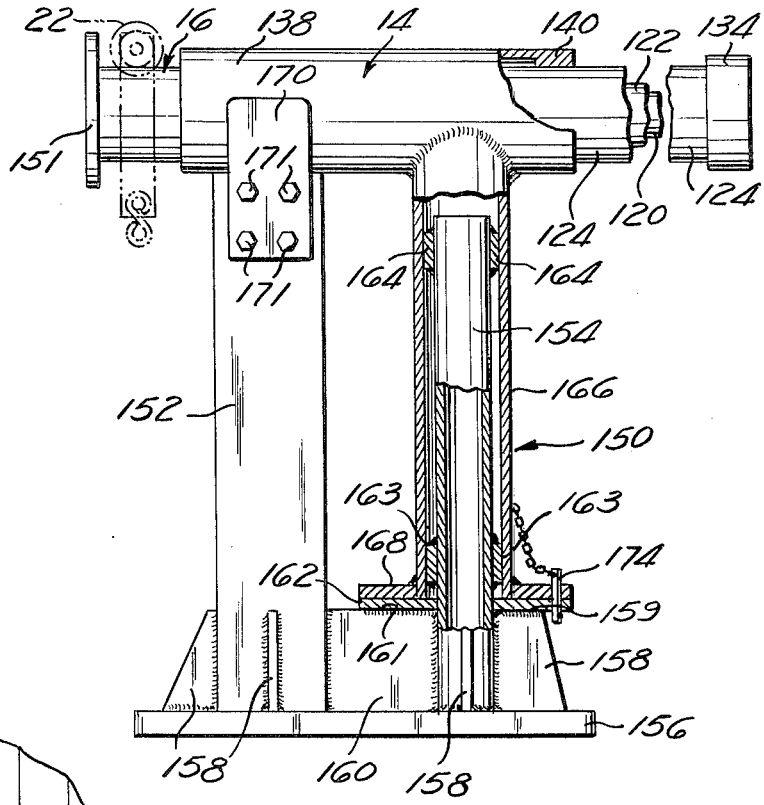
FIG. 9 is a perspective view of a second embodiment of the present invention, permanently mounted inside a room, showing the telescoping pole oriented in three alternative exemplary positions, labeled A, B, and C, respectively.

Referring to FIG. 9, the sleeve 14 is mounted for rotation about a vertical axis on a stand 150, attached to the floor of the building. The stand 150 is preferably mounted indoors, adjacent to a window. Such indoor location protects the pole 16 against adverse weather conditions and thereby insures that it will function properly in an emergency. However, it will be understood that the pole 16 may also be mounted out-of-doors, for example, on a balcony. In either case, the pole 16 is stored in a position interior to the side of the building, and thus, does not protrude therefrom.

The pole 16 is mounted for storage in the sleeve 14, with the telescoping tubes 120,123,124 (FIG. 11) in an unextended or nested position. Since the sleeve 14 rotates with respect to the stand 150, the pole 16 may be oriented relative thereto in any of a variety of positions. Further, the position of the pole 16 may be varied relative to the longitudinal axis of the sleeve 14 by sliding it therein. Typically, however, it will be preferable to position the pole 16 so that it is parallel to the adjacent side wall of the building to prevent it from obstructing the movement of persons within the room. Two exemplary positions for the stored pole are shown in FIG. 9, one in solid lines, labeled position A, and the other in phantom lines, labeled position B. A suitable cover, such as a bar or a table top (not shown), may be detachably mounted on the sleeve 14 or stand 150. This not only hides the pole 16, thereby making it aesthetically attractive, but also provides a functional use for the pole while it is stored.

Figure 10:
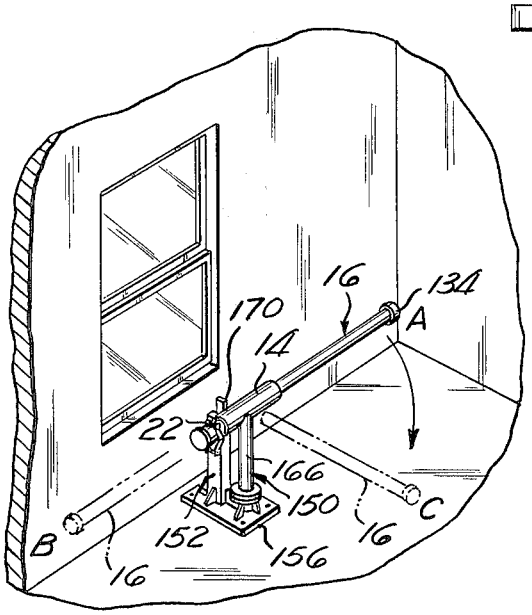
FIG. 10 is a perspective view of the embodiment of FIG. 9, showing the pole after it has been telescopingly extended outwardly, through the window.

In the event of a fire, the table top is removed, and the pole 16 is rotated to a position perpendicular to the window adjacent the stand 150. This position, shown in phantom lines in FIG. 9 as position C, orients the pole 16 so that it may be telescopingly extended out of the window, as shown in FIG. 10. This outward extension of the pole 16 is typically accomplished by first telescopingly sliding the tube 120 out of the tube 122, and then sliding the tube 122 out of the tube 124. The tube 124 is then telescopingly slid through the sleeve 14 until the end portion 134 of the pole 16 abutts the end portion 140 (FIG. 11) of the sleeve 14. Of course, the window through which the pole extends should be open before extending the pole 16 therethrough. However, in the event the user is unable to open the window, the pole 16 may advantageously be used as a battering ram to break the glass. After the pole 16 has been telescoped to its full extension, the user straps himself in the seat 20 and travels to the end of the pole 16 by means of the trolley 22, as previously discussed in reference to FIG. 3.

Figure 11:
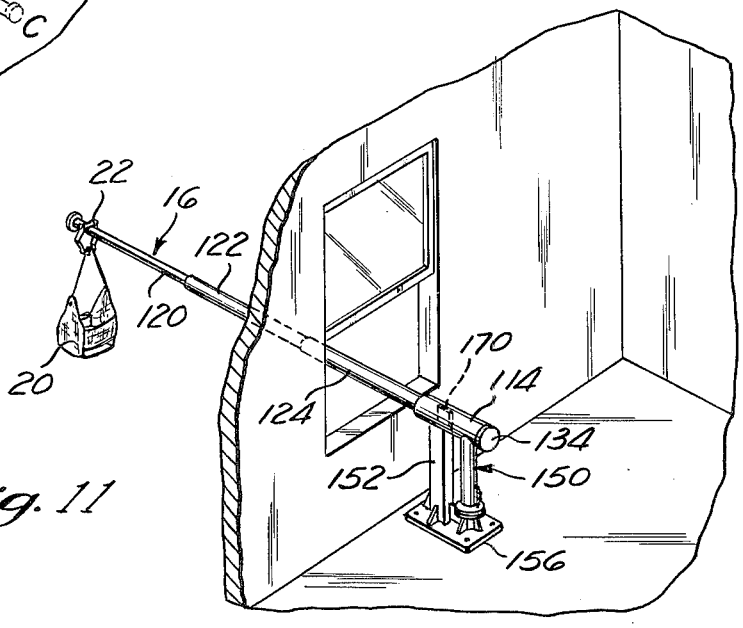
FIG. 11 is an elevation view, in partial cross-section, of the second embodiment, showing the sleeve rotatably mounted on the stand, with the pole stored in the sleeve; a portion of the pole is cut away to show the telescoping tubes which comprise the pole.

Referring to FIGS. 9, 10, and 11, this embodiment includes a stop plate 151, which is identical to the stop plate 24 (FIG. 5), except that it is permanently attached to the end of the pole 16 rather than bolted thereon. In addition, the trolley 22 may be permanently mounted on the pole 16 between the stop plate 151 and sleeve 14. It may also be preferable to permanently attach the seat 20 to the trolley 22. This insures that all of the component parts of the present invention will be assembled and ready for use in the event of an emergency.

Figure 12:
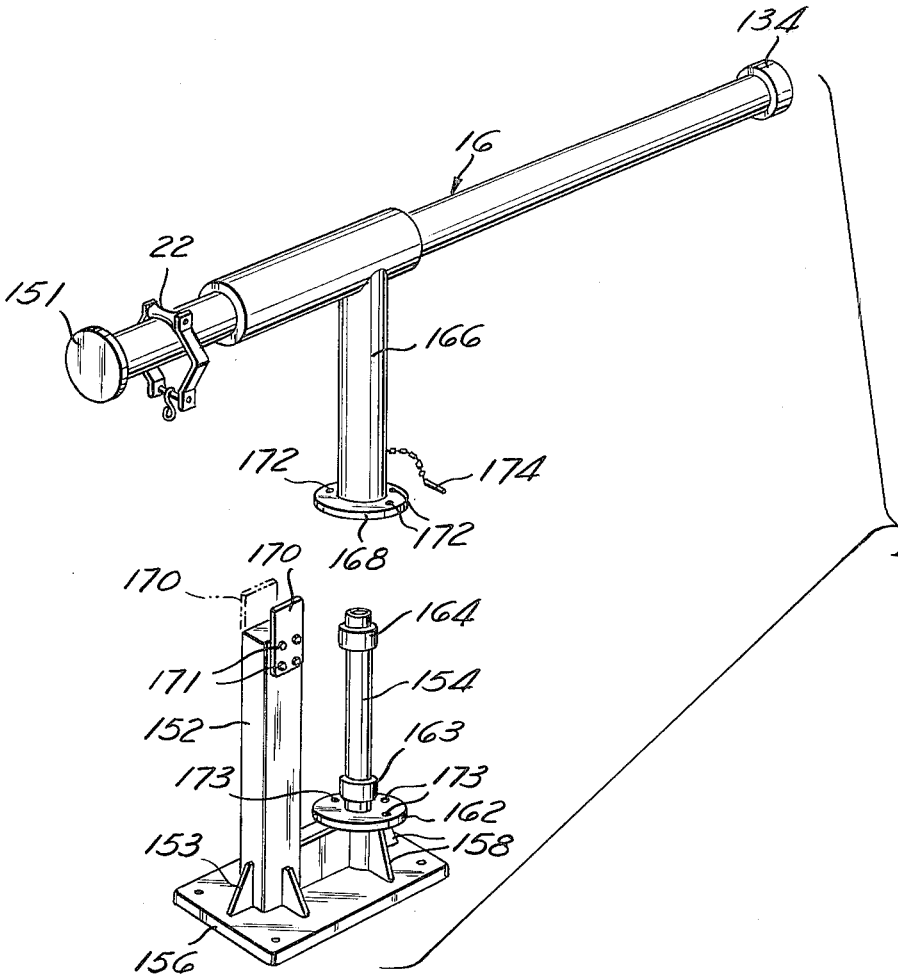
FIG. 12 is an exploded view of the stand, sleeve, and pole of FIG. 11.

The stand 150 comprises a support beam 152, disposed in spaced, parallel relationship to a tubular post 154, as shown in FIGS. 11 and 12. Both the beam 152 and post 154 are connected to a floor-mounted, base plate 156, and project perpendicularly or vertically therefrom. A vertical strut 160 is connected, as by welding, to the base plate 156, between the beam 152 and member 154. Plural support members or gussets 158 are also connected, as by welding, to the beam 152 and post 154 at their junction with the base plate 156 to provide additional strength. The upper portion of the gussets 158 have flats 159 which cooperate with the upper edge 161 of the strut 160 to provide plural bearing surfaces for an annular plate 162, connected to, and projecting radially from, the lower portion of the tubular post 154. This post 154 also has a pair of bushings or collars 163,164 attached thereto. The bushing, 163 is positioned just above the annular plate 161, while the bushing 164 is positioned just below the upper end of the post 154.

Figure 13:
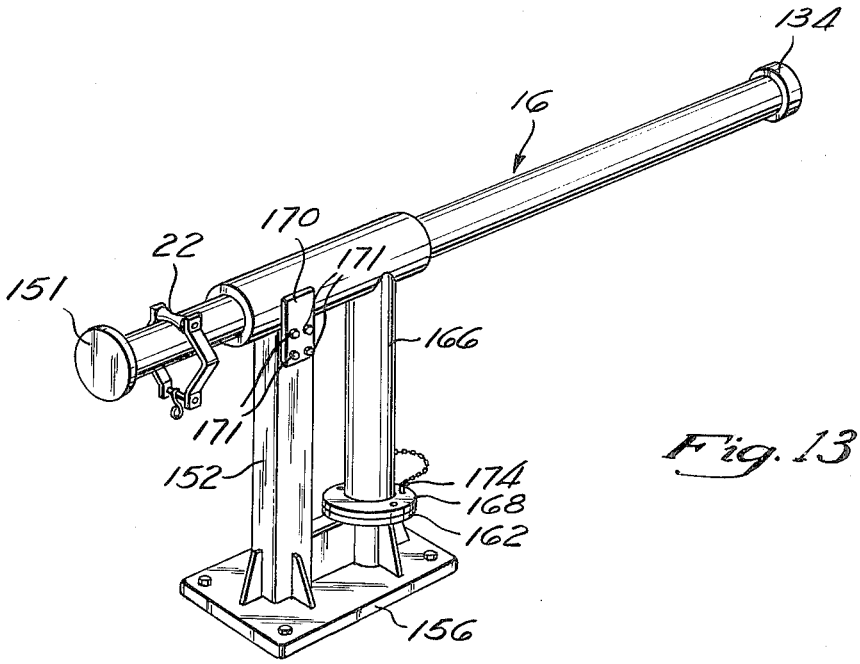
FIG. 13 is a perspective view of the second embodiment showing the sleeve rotatably mounted on the stand, with the pole stored in the sleeve.

A tubular support member 166 is perpendicularly connected, at one end, to the sleeve 14, at a point near the end portion 140. The other end of the member 166 has an annular flange 168 projecting radially therefrom. The bushings 163,164 of the post 154 are sized to telescopingly receive the tubular member 166, and thus, the post 154 rotatably mounts the member 166. The distance between the annular plate 161 and the upper end of the post 154 is slightly less than the length of the tubular support member 166 to prevent the post 154 from extending into the sleeve 14. The annular flange 168 of the member 166 is supported by and bears against the annular plate 162, as shown in FIGS. 11 and 13. Thus, the sleeve 14 may be freely rotated, in a horizontal plane, about the axis of the post 154.

The stand 150 is sized and oriented so that, when the pole 16 is positioned for extension through the window, as illustrated by the position labeled C in FIG. 9, the beam 152 supports the end of the sleeve 14, at a point near the end portion 138. Referring to FIGS. 11, 12, and 13, an alignment plate 170, attached to and extending above one side of the upper end of the beam 152, may be provided to stop the sleeve 14 in a position which aligns it precisely above the beam 152. The alignment plate 170 may be attached, by bolts 171, to either one of opposed sides of the beam 152, as shown in solid and phantom lines, respectively, in FIG. 12. The side of the beam 152 to which the alignment plate 170 is attached depends on the desired stored position for the pole 16. For example, referring to FIG. 9, if the pole is to be stored in position A, the alignment plate 170 will be mounted on the right hand side of the beam 152, as viewed from FIG. 9, to permit the pole 16 to be rotated from position A, parallel to the adjacent side wall, to position C, perpendicular to the adjacent side wall.

Alternatively, if the pole 16 is to be stored in position B, the alignment plate 170 should be mounted on the left side of the beam 152 to permit the pole to be rotated from position B to position C.

Referring again to FIG. 12, the flange 168 and annular plate 162 each have respective plural bores 172,173 therethrough, which are spaced to permit them to align in any of various desired positions, such as the positions A, B, and C of FIG. 9. A pin 174, sized to fit through the bores, is provided to permit the sleeve 14 to be selectively locked in any of these positions, as shown in FIGS. 11 and 13. This prevents rotational movement of the pole 16 relative to the stand 150 when the pole 16 is used as a fire escape, as well as when it is stored.

In both embodiments, the stands 12,150 preferably mount the pole 16 3–5 feet above the floor of the building. This permits ready access to the pole 16 by disabled persons, such as those in wheelchairs.

What is claimed is:

1. A life saving device for use in a high rise building to escape the smoke and heat of a fire, comprising:

a telescoping pole comprising:

a first tube; and a second tube having a diameter smaller than said first tube to permit said second tube to telecope in said first tube;

means for preventing said second tube from sliding out of said first tube when said telescoping pole is fully extended;

means, permanently, rigidly mounted near an opening in a habitable portion of said building, for cantilever supporting said telescoping pole, said pole and said support means having a use configuration in which said second tube is telescopingly extended relative to said first tube to place said pole in an outwardly oriented, horizontal position, which extends away from the side of said building, and having a storage configuration in which said second tube is nested within said first tube for compactness to permit said pole to be stored within said habitable portion of said building to protect it from the weather, while providing ready access thereto, said supporting means comprising a sleeve, connected to a support member, and sized to permit said first tube of said telescoping pole to telescopingly slide therein, said first tube having a stop member which cooperates with said sleeve in said use configuration to prevent said first tube from sliding completely through said sleeve;

a seat for supporting a user;

a trolley mechanism, detachably connected to said seat, and mounted on said pole, for supporting said user from said pole and permitting said user to travel outwardly along said pole, away from said building; and means, connected to said pole, for restricting travel of said trolley mechanism when said user reaches the outward end of said pole.

* * * * *